US006190502B1

(12) United States Patent
Takeuchi et al.

(10) Patent No.: US 6,190,502 B1
(45) **Date of Patent: *Feb. 20, 2001**

(54) WATER-DISINTEGRATABLE FIBROUS SHEET

(75) Inventors: Naohito Takeuchi; Takayoshi Konishi, both of Kagawa (JP)

(73) Assignee: Uni-Charm Corporation, Ehime (JP)

( * ) Notice: This patent issued on a continued prosecution application filed under 37 CFR 1.53(d), and is subject to the twenty year patent term provisions of 35 U.S.C. 154(a)(2).

Under 35 U.S.C. 154(b), the term of this patent shall be extended for 0 days.

(21) Appl. No.: 09/120,105

(22) Filed: Jul. 21, 1998

(30) Foreign Application Priority Data

Aug. 5, 1997 (JP) ..... 9-210436

(51) Int. Cl.[7] ..... D21F 11/00

(52) U.S. Cl. ..... 162/158; 162/158; 162/168.1; 424/402; 428/74; 428/249; 428/490

(58) Field of Search ..... 162/158, 168.1; 424/402; 428/74, 249, 490

(56) References Cited

U.S. PATENT DOCUMENTS

| | | |
|---|---|---|
| 4,309,469 | 1/1982 | Varona . |
| 5,252,332 | 10/1993 | Goldstein . |
| 5,281,306 | 1/1994 | Kakiuchi . |

FOREIGN PATENT DOCUMENTS

| | | |
|---|---|---|
| 0569699 | 11/1993 | (EP) . |
| 3-292924 | 12/1991 | (JP) . |
| 6-198778 | 7/1994 | (JP) . |
| 7-24636 | 3/1995 | (JP) . |
| 002083684 | 7/1997 | (JP) . |

*Primary Examiner*—Peter Chin
*Assistant Examiner*—Mark Halpern
(74) *Attorney, Agent, or Firm*—Koda & Androlia

(57) ABSTRACT

A fibrous sheet coated with a water-soluble binder of polyvinyl alcohol is impregnated with an aqueous solution dissolved with water-soluble carboxylate, so as to produce a water-disintegratable fibrous sheet. Salting out of the polyvinyl alcohol with the carboxylate maintains wet strength of the water-disintegratable fibrous sheet even in a wet state, which is easily disintegrated when immersed in a large amount of water after use. Furthermore, it does not suffer from deterioration in water-disintegratability and wet strength if it is left at high temperatures, and is good in water-disintegratability in cold water.

7 Claims, No Drawings

WATER-DISINTEGRATABLE FIBROUS SHEET

FIELD OF THE INVENTION

The present invention relates to a water-disintegratable fibrous sheet that is easily dispersed by flushing water, and more particularly, relates to a water-disintegratable fibrous sheet that is excellent in water-disintegratability, strength, heat-resistance and water-disintegratability in cold water.

BACKGROUND OF THE INVENTION

Fibrous sheets are used to cleanse human skin, e.g., skin around anus, and to clean a toilet room. The fibrous sheet is preferably water-disintegratable to be thrown away and drained in a toilet as it is. If it is not excellent in water-disintegratability, it requires a long time to be dispersed in a septic tank, and brings danger of clogging drainpipes of a toilet, when being thrown away and drained in a toilet. However, in general, a packed fibrous sheet impregnated with a cleansing liquid or the like has to be strong enough to endure conducting wiping operations while being impregnated with a cleansing liquid, and at the same time, has to keep its water-disintegratability in the event of being thrown away and drained in a toilet. Therefore, a water-disintegratable fibrous sheet that has good water-disintegratability and strength sufficient to use is demanded.

Japanese Patent Publication H7-24636, for example, discloses a water-disintegratable cleaning product composed of water-soluble binders containing a carboxyl group, metallic ions, and an organic solvent. However, the metallic ions are irritative to skin.

Japanese Laid-Open Patent H3-292924 discloses a water-disintegratable cleaning product composed of fibers containing polyvinyl alcohol impregnated with an aqueous solution of boric acid. Japanese Laid-Open Patent H6-198778 discloses a water-disintegratable sanitary napkin composed of non-woven fabric containing polyvinyl alcohol added with boric ion and bicarbonic ion. In these inventions, fibrous sheets are produced by binding each fiber using properties such that boric acid cross-links polyvinyl alcohol. However, a large amount of binder, i.e., polyvinyl alcohol, is required to produce fibrous sheets having strength sufficient to use.

Furthermore, miscellaneous products, including such water-disintegratable products, are often left in a vehicle or a warehouse during their transportation and storage, and the temperatures in such a closed space rise above the outer atmospheric temperature. In the case where they are stored in a house, they may be possibly left under a temperature of 40° C. or higher in the middle of summer. When water-disintegratable fibrous sheets which are previously impregnated are packed as finished products and then shipped to market, water-disintegratability and strength of the fibrous sheets are remarkably deteriorated if they are left under high temperature circumstances. Therefore, a water-disintegratable fibrous sheet has to retain its water-disintegratability and strength even under high temperature circumstances, that is ,its heat-resistance is important. However, there is no report relating to the heat-resistance in the water-disintegratable cleaning products and the water-disintegratable non-woven fabric disclosed in the preceding publications.

Water temperatures are generally lower than the atmospheric temperature though they vary depending on seasons. When a fibrous sheet is thrown away and drained in a toilet after used, it has to be disintegrated in water at a temperature lower than the atmospheric temperature, i.e., in cold water.

However, as to the fibrous sheet using polyvinyl alcohol as a binder, its water-disintegratability is generally enhanced in response to a rise in temperatures of water, but deteriorated in response to a fall in temperatures of water.

SUMMARY OF THE INVENTION

An object of the present invention is to provide a water-disintegratable fibrous sheet that has excellent water-disintegratability, while being strong enough to withstand wiping operations Another object of the present invention is to provide a water-disintegratable fibrous sheet that is excellent in heat-resistance.

Still another object of the present invention is to provide a water-disintegratable fibrous sheet that is excellent in water-disintegratability even in cold water.

Still another object of the present invention is to provide a water-disintegratable fibrous sheet that does not exert harmful influence on human bodies.

The present inventors have made attention to that electrolytes have a function of salting out of polyvinyl alcohol, and have found that a water-disintegratable fibrous sheet, which is excellent in water-disintegratability, strength and heat-resistance, can be obtained by particularly using carboxylate among the electrolytes.

The present invention provides a water-disintegratable fibrous sheet comprising fibers which are bound with a water-soluble binder and formed into a sheet form, wherein the binder comprises polyvinyl alcohol and water-soluble carboxylate is added to the sheet.

DETAILED DESCRIPTION OF THE INVENTION

In the present invention, the salting out of the polyvinyl alcohol with an electrolyte, such as a water-soluble carboxylate, maintains strength of the fibrous sheet, even in such a state that the fibrous sheet bound with the polyvinyl alcohol is impregnated with a cleansing liquid and the like, i.e., in a wet state. That is, a deterioration of binding strength among the fibers is prevented by the salting out of the polyvinyl alcohol with the water-soluble carboxylate. Then, when it encounters a large amount of water, the electrolyte is dissolved in water, thus the polyvinyl alcohol in a salting out state is also dissolved, and as a result, water-disintegratability is exhibited.

The water-soluble carboxylate is preferably at least one selected from the group consisting of sodium tartrate, potassium tartrate, sodium citrate, potassium citrate, sodium malate, and potassium malate. By using these salts, the water-disintegratable fibrous sheet can be produced with excellent water-disintegratability and strength. When using these salts, the carboxylate is preferably present in an amount of 1.25 g or more per 100 g of the fibers, so as to enhance strength of the water-disintegratable fibrous sheet. The water-disintegratable fibrous sheet of the present invention is preferably in a wet state, where the fibrous sheet is impregnated with an aqueous solution in which the carboxylate is dissolved, so that the carboxylate is efficiently contained in the fibrous sheet.

The polyvinyl alcohol is preferably present in an amount of 3 to 30 g per 100 g of the fibers. If the amount of the polyvinyl alcohol is more than 30 g, the resulting fibrous sheet becomes too stiff, whereas it is less than 3 g, the intended strength of the fibrous sheet cannot be obtained. From the viewpoint of water-disintegratability of the fibrous sheet, furthermore, the polyvinyl alcohol preferably has a saponification degree of 80 to 92%. It is preferred that the polyvinyl alcohol is coated as a binder on a surface of a web of fibers because of easiness of production.

The contents of the carboxylate and the polyvinyl alcohol is preferably 1.25 g or more of the carboxylate per 3 to 30 g of the polyvinyl alcohol. Water-disintegratability and strength of the water-disintegratable fibrous sheet are well-balanced in this range.

In the case where the water-disintegratable fibrous sheet of the present invention is used as wet-type tissue paper, a basis weight of the fibers is preferably 20 to 100 g/m$^2$. The fibrous sheet of the present invention can be used satisfactorily as wet-type tissue paper in this range.

The water-disintegratable fibrous sheet of the present invention, which is characterized by comprising the fibers bound with the water-soluble binder and formed into the sheet form, in which the binder comprises the polyvinyl alcohol and the water-soluble carboxylate is added to the sheet, will be described in more detail below.

In the fibrous sheet of the present invention, fibers having good dispersibility in water are used. The term "dispersibility in water" used herein has the same meaning as water-disintegratability, i.e., the properties such that it is divided into minute parts upon contacting a large amount of water.

One or both of natural fibers and chemical fibers can be used as the fibers contained in the water-disintegratable fibrous sheet of the present invention. Examples of the natural fibers include wood pulp, and examples of the chemical fibers include rayon as a regenerated fiber and polypropylene as a synthetic fiber. With using these fibers as a main component, the fibers may further contain natural fibers such as cotton, rayon, synthetic fibers such as polypropylene, polyvinyl alcohol, polyester and polyacrylonitrile, synthetic pulp made of polyethylene and the like, and inorganic fibers such as glass wool.

The basis weight of the fibers used in the present invention is preferably 20 to 100 g/m$^2$. If the basis weight is less than 20 g/m$^2$, the strength cannot be obtained which is necessary when the fibrous sheet is used as a sheet for wiping operations. Also, if the basis weight is less than 20 g/m$^2$, the fibrous sheet becomes stiff because the characteristics of the polyvinyl alcohol coated as a binder becomes dominant, resulting in lowering of softness. If the basis weight is more than 100 g/m$^2$, flexibility as a fibrous sheet is lost. Also, if the basis weight is more than 100 g/m$^2$, a large amount of the polyvinyl alcohol must be coated as a binder, resulting in a fibrous sheet that lacks water-disintegratability. When the fibrous sheet of the present invention is used as a fibrous sheet for wiping skin around anus or cleaning, the basis weight of the fibers is more preferably 30 to 70 g/m$^2$ from the viewpoint of strength and softness.

The fibrous sheet of the present invention can be produced by any of a dry laid process and a wet laid process that are conventionally practiced in the art. For example, when the fibrous sheet is produced by the wet laid process, a fiber web produced is dried, and then polyvinyl alcohol as a binder is coated by a silk-screen process or the like. The fiber web is a sheet-formed lump of fibers wherein the directions of the fibers are arranged to some extent. In the fibrous sheet thus produced, the binding among the fibers is reinforced by the polyvinyl alcohol as a binder.

There are many kinds of polyvinyl alcohol having various saponification degrees and polymerization degrees.

With respect to the saponification degree of the polyvinyl alcohol used in the present invention, one or both of completely saponified products and partially saponified products can be used. Specifically, partially saponified products are preferred from the viewpoint of water-disintegratability. The saponification degree of the polyvinyl alcohol is preferably 80 to 92%. If the saponification degree is less than 80%, strength of the water-disintegratable fibrous sheet is lowered, and the fibrous sheet tends to be broken on wiping operations to wipe skin around anus or for cleaning. If the saponification degree is more than 92%, water-disintegratability is deteriorated even though strength becomes high. The saponification degree is more preferably 82 to 88% from the viewpoint of water-disintegratability and strength. In the case where polyvinyl alcohol having a low saponification degree is used, strength sufficient to use on wiping operations can be obtained by increasing its amount coated on the fibrous sheet.

The polymerization degree (i.e., average polymerization degree) of the polyvinyl alcohol is preferably about 100 to 2,000. If the polymerization degree is less than 100, strength of the fibrous sheet becomes insufficient because it cannot exhibit the properties of the binder that reinforces the connection among the fibers. If the polymerization degree is more than 2,000, its excessively high viscosity disadvantageously prevents uniform coating onto the fibrous sheet on production. Furthermore, the resulting fibrous sheet lacks softness and becomes hard and stiff to the touch, and therefore is difficult to be used as a commercial product. The polymerization degree is more preferably about 1,000 to 1,800 from the viewpoint of water-disintegratability and softness of the water-disintegratable fibrous sheet.

The amount (coated amount) of the polyvinyl alcohol is preferably 3 to 30 g per 100 g of the fibers. If the amount is less than 3 g, strength of the fibrous sheet is lowered. If the amount is more than 30 g, the fibrous sheet becomes stiff and has lowered softness, resulting in deteriorated feeling on use. In this case, water-disintegratability is also lowered. The amount of the polyvinyl alcohol is more preferably 5 to 20 g per 100 g of the fibers from the viewpoint of water-disintegratability and softness.

In the present invention, the carboxylate is used as a material that can subject the polyvinyl alcohol to salting out and is water-soluble. As a method of adding the carboxylate to the fibrous sheet, it is efficient to impregnate the fibrous sheet with an aqueous solution in which the carboxylate is dissolved. The carboxylate is preferably at least one carboxylate selected from the group consisting of sodium tartrate, potassium tartrate, sodium citrate, potassium citrate, sodium malate and potassium malate. These are excellent in water-solubility and have no danger of exerting harmful influence on human bodies. Among these, tartrates such as sodium tartrate and potassium tartrate are more preferably used. Water-disintegratability, strength and heat-resistance of the fibrous sheet can further be improved by using tartrates.

When the carboxylate is selected from sodium tartrate, potassium tartrate, sodium citrate, potassium citrate, sodium malate and potassium malate, it is preferred that the carboxylate is present in an amount of 1.25 g or more per 100 g of the fibers. For example, 100 g of the fibers is impregnated with 250 g of an aqueous solution having a carboxylate concentration of 0.5% by weight or more. If the amount of the carboxylate is less than the above amount, strength in the wet state is insufficient and water-disintegratability is deteriorated. In such a case, strength can be improved by increasing the amount of the polyvinyl alcohol to be coated on the fibrous sheet. However, if the amount of the polyvinyl alcohol is excessive, the softness of the resulting fibrous sheet is lowered. It is more preferred that the carboxylate is present in an amount of 2.50 g or more per 100 g of the fibers. In the fibrous sheet, the higher the content of the carboxylate is, the better water-disintegratability and strength are. Therefore, when the saponification degree of the polyvinyl alcohol is low, strength of the water-disintegratable fibrous sheet can be improved by increasing the amount of the carboxylate. The upper limit of the amount of the carboxylate is not particularly limited. It was found that when the fibrous sheet was impregnated with 250 g of an aqueous solution per 100 g of the fibers, the carboxylate concentration of 36% by weight exhibited excellent results in both water-disintegratability and strength.

The water-disintegratable fibrous sheet obtained by the above manner does not suffer from deterioration in its water-disintegratability and strength even if it is stored in circumstances of higher temperatures than the ordinary atmospheric temperature, for example, at 40° C. Furthermore, it does not suffer from deterioration in its water-disintegratability even in water at lower temperatures, for example, at 10° C.

In the water-disintegratable fibrous sheet of the present invention, another materials may be added if they do not spoil the effects of the present invention. For example, a surfactant, a disinfectant, a preservative, a deodorizer, a moistening agent, an alcohol and the like can be added. These materials can be added to the aqueous solution in which the carboxylate to be added to the fibrous sheet is dissolved, so as to improve the fibrous sheet.

The water-disintegratable fibrous sheet of the present invention can be used as wet-type tissue paper applied to human skin, for example, wiping skin around anus, and can be used for cleaning a toilet room. If the water-disintegratable fibrous sheet of the present invention is packed as a product previously wetted, it is sold by sealed up to prevent the fibrous sheet from drying.

Alternatively, the water-disintegratable fibrous sheet of the present invention can be sold in a dry state. For example, a web of fibers is coated with polyvinyl alcohol and impregnated with an aqueous solution in which carboxylate is dissolved, followed by drying. The dried water-disintegratable fibrous sheet may be impregnated with a liquid drug or water upon use.

The present invention will be described in more detail below with reference to various examples, but the invention is not construed as being limited to these examples.

EXAMPLE 1

By using 100% of bleached kraft pulp of conifer (Canadian Standard Freeness (CSF): 740 ml) as a raw material fiber, a base fibrous sheet having a basis weight of 50 g/m$^2$ was prepared by a wet laid process by using a paper machine with round mesh. After drying the base fibrous sheet, 10 g/m$^2$ of polyvinyl alcohol was coated on the surface of the base fibrous sheet to prepare a fibrous sheet. As a method for coating, the polyvinyl alcohol was uniformly coated on the base fibrous sheet by using a silk-screen (60 mesh). After coating, it was dried at 170° C. for 2 minutes by using a hot air stream dryer. The polyvinyl alcohol used had a saponification degree of 88% and a average polymerization degree of 1,700 ("PVA-217", a product of Kuraray Co., Ltd.).

The fibrous sheet obtained by the above-described manner was impregnated with an aqueous solution in which carboxylate was dissolved, in an amount of 250 g per 100 g of the fibers. The resulting water-disintegratable fibrous sheet as an example of the present invention was subjected to the test of water-disintegratability, wet strength and heat-resistance. On the other hand, the fibrous sheets coated with the polyvinyl alcohol were impregnated with an aqueous solution containing 0.8% by weight of borax and an aqueous solution containing 12.0% by weight of mirabilite, respectively, to be comparative examples. The comparative examples were subjected to the test of water-disintegratability, wet strength and heat-resistance in the same manner as in the example.

The test of water-disintegratability was conducted according to the test of water-disintegratability of toilet paper regulated under JIS P4501 (Japanese Industrial Standard ). (In the Tables, the results are shown in terms of second.)

The test of water-disintegratability of toilet paper in JIS P4501 will be described below. A 300-ml beaker filled with 300 ml of water (20±5° C.) is put on a magnetic stirrer, and the rotation speed of a rotor is controlled to 600±10 r.p.m. A test piece having a dimension of 114 mm±2 mm square is put in the beaker, and the stopwatch is started. The rotation speed of the rotor is once lowered to about 500 r.p.m. due to the resistance of the test piece. By gradual water-disintegration of the test piece, the rotation speed is then increased. At the time when the rotation speed restores 540 r.p.m., the stopwatch is stopped to measure the time with the unit of second. The rotor used has a disk shape of 35 mm in diameter and 12 mm in thickness.

The time to disintegrate the test piece is detected by the rotation speed in the JIS Standard. The substantially same results can be obtained by detecting the time to disintegrate the test piece by eye.

Wet strength was measured in such a manner that the above-obtained fibrous sheet was cut to a test piece having a dimension of 25 mm width and 150 mm length, and strength of the test piece was measured with a Tensilon test machine at a chuck distance of 100 mm and a tensile speed of 100 m/min. Strength at breakage (gf) was taken as a test result of wet strength. (In the Tables, the results are shown in terms of g/25 mm.)

For the test of heat-resistance, the water-disintegratable fibrous sheet was sealed up in a polypropylene envelope and then placed in a polyethylene container, and was stored at an atmosphere of 40° C. for 24 hours. After the storage, the fibrous sheet was subjected to the above-described tests for water-disintegratability and wet strength.

The results obtained are shown in Table 1.

TABLE 1

| | Comparative Example of Borax | Comparative Example Of Mirabilite | Example of Sodium Tartarate |
|---|---|---|---|
| Concentration of Aqueous Solution (% by weight) | 0.8 | 12.0 | 18.0 |
| Water-disintegratability (second) | 182 | 330 | 132 |
| Wet Strength (g/25 mm) | 2511 | 2113 | 3121 |
| Water-disintegratability (second) in Heat-resistance Test | 226 | 563 | 159 |
| Wet Strength (g/25 mm) in Heat-resistance Test | 612 | 1852 | 2956 |

It is understood from the result of Table 1 that in the example using sodium tartrate, the comparison between the results of water-disintegratability and that after the storage for heat-resistance test reveals that the time to disintegrate the fibrous sheet suffers substantially no change. That is, excellent water-disintegratability was maintained even after the storage at a high temperature. There was small decrease in wet strength in the heat-resistance test, as well.

EXAMPLE 2

A fibrous sheet was prepared in the same manner as in Example 1. Aqueous solutions each containing sodium citrate, potassium tartrate and sodium tartrate as carboxylates were prepared. The concentrations of the carboxylates were each 18% by weight. The fibrous sheet thus prepared was impregnated with each of the aqueous solutions in an amount of 250 g per 100 g of the fibers. The resulting water-disintegratable fibrous sheets were measured in water-disintegratability and wet strength, as well as in water-disintegratability and wet strength in the heat-resistance test. The measurement methods were the same as in Example 1.

The results obtained are shown in Table 2.

TABLE 2

| | Example of Sodium Citrate | Example of Potassium Tartarate | Example of Sodium Tartarate |
|---|---|---|---|
| Concentration of Aqueous Solution (% by weight) | 18.0 | 18.0 | 18.0 |
| Water-disintegratability (second) | 189 | 118 | 132 |
| Wet Strength (g/25 mm) | 3345 | 3642 | 3121 |
| Water-disintegratability (second) in Heat-resistance Test | 211 | 123 | 159 |
| Wet Strength (g/25 mm) in Heat-resistance Test | 3222 | 3571 | 2956 |

It is understood from the results of Table 2 that the fibrous sheets excellent in water-disintegratability and wet strength were obtained by using any of the aqueous solutions of sodium citrate, potassium tartrate and sodium tartrate, and water-disintegratability and wet strength did not deteriorate much in the heat-resistance test. Particularly, the fibrous sheets using tartrates were excellent not only in water-disintegratability but also in maintaining water-disintegratability in the heat-resistance test.

EXAMPLE 3

A fibrous sheet was prepared in the same manner as in Example 1. Aqueous solutions each containing sodium tartrate as carboxylate in concentrations of 13.5% by weight, 18.0% by weight and 36.0% by weight were prepared. The fibrous sheet thus prepared was impregnated with each of the aqueous solutions in an amount of 250 g per 100 g of the fibers. The resulting water-disintegratable fibrous sheets were measured in water-disintegratability and wet strength, as well as in water-disintegratability and wet strength in the heat-resistance test. The measurement methods were the same as in Example 1. As a comparative example, the tests for water-disintegratability and wet strength were also conducted for sodium sulfate generally used in the art as a material subjecting polyvinyl alcohol to salting out. The concentrations of the aqueous solutions of sodium sulfate were 5.0% by weight, 7.0% by weight and 12.0% by weight.

The results obtained are shown in Table 3.

TABLE 3

| | Comparative Example of Sodium Sulfate | | | Example of Sodium Tartarate | | |
|---|---|---|---|---|---|---|
| Concentration of Aqueous Solution (% by weight) | 5.0 | 7.0 | 12.0 | 13.5 | 18.0 | 36.0 |

TABLE 3-continued

| | Comparative Example of Sodium Sulfate | | | Example of Sodium Tartarate | | |
|---|---|---|---|---|---|---|
| Water-disintegratability (second) | 114 | 218 | 330 | 177 | 132 | 63 |
| Wet Strength (g/25 mm) | 1032 | 1558 | 2113 | 1847 | 3121 | 4681 |
| Water-disintegratability (second) in Heat-resistance Test | 222 | 432 | 563 | 196 | 159 | 69 |
| Wet Strength (g/25 mm) in Heat-resistance Test | 1003 | 1440 | 1852 | 1732 | 2956 | 4666 |

It is understood from the results of Table 3 that when the concentration of sodium tartrate became higher, the fibrous sheet was water-disintegrated in a shorter time and wet strength became higher. Furthermore, in the heat-resistance test, the higher the concentration of sodium tartrate was, the better water-disintegratability was and the higher wet strength was.

EXAMPLE 4

To the base fibrous sheet prepared in the same manner as in Example 1, polyvinyl alcohols having various saponification degrees were coated in an amount of 10 g/m$^2$. The saponification degrees of the polyvinyl alcohols used were 80, 82, 84, 88, 99. ("PVA", "PVA-420", "PVA-317" and "PVA-217" in this order, products of Kuraray Co., Ltd.).

The resulting fibrous sheets were impregnated with an aqueous solution, in which 18% by weight of sodium tartrate was dissolved, in an amount of 250 g per 100 g of the fibers. The resulting water-disintegratable fibrous sheets were measured in water-disintegratability and wet strength, as well as in water-disintegratability and wet strength in the heat-resistance test. The measurement methods were the same as in Example 1.

The results obtained are shown in Table 4.

TABLE 4

| | Example of PVA | Example of PVA-420 | Example of PVA-317 | Example of PVA-217 |
|---|---|---|---|---|
| Saponification Degree (%) | 80 | 81 | 84 | 88 |
| Polymerization Degree | 1700 | 1700 | 1700 | 1700 |
| Water-disintegratability (second) | 40 | 66 | 86 | 132 |
| Wet Strength (g/25 mm) | 824 | 1165 | 1532 | 3121 |
| Water-disintegratability (second) in Heat-resistance Test | 71 | 80 | 94 | 159 |
| Wet Strength (g/25 mm) in Heat-resistance Test | 788 | 1045 | 1470 | 2956 |

It is understood from the results of Table 4 that the higher the saponification degree of polyvinyl alcohol, the higher wet strength of the fibrous sheet. In all the examples each of which were different in saponification degree of polyvinyl alcohol, decrease in water-disintegratability and wet strength in the heat-resistance test was small.

EXAMPLE 5

To the base fibrous sheet prepared in the same manner as in Example 1, polyvinyl alcohol was coated in various amounts. The amounts of polyvinyl alcohol coated were 3 g, 5 g, 20 g and 30 g per 100 g of the fibers. The polyvinyl alcohol used had a saponification degree of 88% and a average polymerization degree of 1,700 ("PVA-217", a product of Kuraray Co., Ltd.). As a comparative example, a fibrous sheet, in which no polyvinyl alcohol was coated on the base fibrous sheet, was prepared.

The resulting fibrous sheets were impregnated with an aqueous solution, in which 18% by weight of sodium tartrate was dissolved, in an amount of 250 g per 100 g of the fibers. The resulting water-disintegratable fibrous sheets were measured in water-disintegratability and wet strength. The measurement methods were the same as in Example 1. The same tests were conducted for the comparative example.

The results are shown in Table 5.

TABLE 5

| | Comparative Example | Example | | | |
|---|---|---|---|---|---|
| Coated Amount of Polyvinyl Alcohol (% by weight) | 0 | 3 | 5 | 20 | 30 |
| Water-disintegratability (second) | 4 | 25 | 66 | 132 | 211 |
| Wet Strength (g/25 mm) | 30 | 470 | 1020 | 3121 | 4681 |

It is understood from the results of Table 5 that the higher the coated amount of polyvinyl alcohol, the higher wet strength.

EXAMPLE 6

A fibrous sheet was prepared in the same manner as in Example 1. An aqueous solution was prepared by dissolving sodium tartrate as carboxylate to a concentration of 18% by weight. The fibrous sheet prepared was impregnated with the aqueous solution in an amount of 250 g per 100 g of the fibers. The resulting water-disintegratable fibrous sheets were measured in water-disintegratability and wet strength, as well as in water-disintegratability in cold water. The measurement method for water-disintegratability and wet strength was the same as in Example 1. The test for water-disintegratability in cold water was conducted according to the test of water-disintegratability of toilet paper in JIS P4501 wherein the water temperature was 10° C.

As comparative examples, the fibrous sheet prepared was impregnated with each of an aqueous solution containing 0.8% by weight of borax and an aqueous solution containing 12.0% by weight of sodium sulfate, to produce water-disintegratable fibrous sheets. The amount of the aqueous solutions was 250 g per 100 g of the fibers. The comparative examples were measured in water-disintegratability and wet strength, as well as in water-disintegratability in cold water in the same manner as in the examples.

The results obtained are shown in Table 6.

TABLE 6

| | Comparative Example of Borax | Comparative Example of Sodium Sulfate | Example of Sodium Tartarate |
|---|---|---|---|
| Concentration of Aqueous Solution (% by weight) | 0.8 | 12.0 | 18.0 |
| Water-disintegratability (second) | 182 | 330 | 132 |

TABLE 6-continued

| | Comparative Example of Borax | Comparative Example of Sodium Sulfate | Example of Sodium Tartarate |
|---|---|---|---|
| Wet Strength (g/25 mm) | 2511 | 2113 | 3121 |
| Water-disintegratability (second) in Cold Water (10° C.) | 612 | 1852 | 2956 |

It is understood from the results of Table 6 that in the examples using sodium tartrate, the comparison between the results of water-disintegratability test and the results of water-disintegratability test in cold water reveals that the time to disintegrate the fibrous sheet suffers substantially no change.

As described above, the water-disintegratable fibrous sheet of the present invention maintains strength sufficient to use even in a wet state, and is easily disintegrated when immersed in a large amount of water after use. Further, it does not suffer from deterioration in water-disintegratability and strength if it is left at high temperatures. Still further, it is good in water-disintegratability in cold water.

What is claimed is:

1. A water-disintegratable fibrous sheet for use in wet conditions comprising fibers which are bound with a water-soluble binder and formed into a sheet form and a water-soluble carboxylate added to the sheet, wherein the binder consists of polyvinyl alcohol and the water-soluble carboxylate is for salting out the polyvinyl alcohol and consists of at least one selected from the group consisting of sodium tartrate, sodium citrate, potassium citrate, sodium malate, potassium malate and potassium tartrate, the basis weight of the fibers is 20–100 g/m$^2$, and the water-soluble binder is present in an amount of 3–30 g per 100 g of fibers.

2. A water-disintegratable fibrous sheet as claimed in claim 1, wherein the water-disintegratable fibrous sheet is in a wet state by impregnation with an aqueous solution wherein the carboxylate is dissolved.

3. A water-disintegratable fibrous sheet as claimed in claim 2, wherein the fibrous sheet is produced by coating the binder of polyvinyl alcohol on a surface of a web of the fibers.

4. A water-disintegratable fibrous sheet as claimed in claim 3, wherein the polyvinyl alcohol has a saponification degree of 80 to 92%.

5. The water-disintegratable fibrous sheet as claimed in claim 4, wherein said polyvinyl alcohol has a polymerization degree of 100–2000.

6. The water-disintegratable wiping sheet as claimed in claim 5, wherein a content of said carboxylate is 1.25 g or more per 100 g of said fibers.

7. The water-disintegratable wiping sheet as claimed in claim 1, wherein:

said carboxylate is one selected from the group consisting of sodium tartrate and potassium tartrate, and a content of said carboxylate is 2.50 g or more per 100 g of said fibers; and said polyvinyl alcohol has a polymerization degree of 1000–1800, a saponification degree of 82 to 88%, and a content thereof is 5 to 20 g per 100 g of said fibers.

* * * * *